US006669530B2

(12) United States Patent
Du

(10) Patent No.: US 6,669,530 B2
(45) Date of Patent: Dec. 30, 2003

(54) MULTI-PURPOSE PAPER DISK, CONFETTI, OR FLUID PROJECTING DEVICE

(76) Inventor: John Du, 925 Pebble Beach Pl., Placentia, CA (US) 92870

( * ) Notice: Subject to any disclaimer, the term of this patent is extended or adjusted under 35 U.S.C. 154(b) by 0 days.

(21) Appl. No.: 10/160,024

(22) Filed: May 30, 2002

(65) Prior Publication Data

US 2003/0143922 A1 Jul. 31, 2003

Related U.S. Application Data

(60) Provisional application No. 60/352,627, filed on Jan. 28, 2002.

(51) Int. Cl.[7] ..... A63H 37/00
(52) U.S. Cl. ..... 446/475; 124/16
(58) Field of Search ..... 124/16, 26, 66; 446/475

(56) References Cited

U.S. PATENT DOCUMENTS 825,843 A * 7/1906 Kliemandt
944,715 A * 12/1909 Blodgett
1,324,092 A * 12/1919 Worswick
1,421,234 A * 6/1922 Houghton
2,111,631 A * 3/1938 Jones et al.
5,556,319 A * 9/1996 Watkins ..... 446/475
5,597,160 A * 1/1997 Mims ..... 124/16
5,634,840 A * 6/1997 Watkins ..... 446/475
5,690,089 A * 11/1997 Ward

* cited by examiner

*Primary Examiner*—John A. Ricci

(57) ABSTRACT

A multi-purpose projecting device for propelling and disseminating, generally vertically, paper disks, confetti, or fluid contained in a cartridge. Contents of the cartridge as well as the outside surface of the launching tube may be covered with a fluorescent material. The launching tube may serve as a flagpole to supplement its primary function at large social gatherings such as sporting or music events, wedding ceremonies, holiday celebrations, etc. The device consists of a two-part cylindrical launching apparatus and a cylindrical cartridge that may hold paper disks, confetti, fluid, or other soft materials such as fiber, string, fabric, etc. The upper section of the launching tube folds back, into which the cartridge can then be inserted. The lower section of the launching tube consists of a spring, a plunger, a spring, a string, and a trigger. After the cartridge is loaded, a string connecting to the plunger is pulled, contracting the spring and setting the trigger ready for launching. The upper section of the tube is then restored to its original position. Pressing the trigger releases the plunger, which moves along the launching tube due to pressure from the extending spring. The plunger compresses air within the tube, propelling contents of the cartridge through the upper section of the launching tube to be ejected.

20 Claims, 7 Drawing Sheets

MULTI-PURPOSE PAPER DISK, CONFETTI, OR FLUID PROJECTING DEVICE

This application claim the benefit of provisional application Ser. No. 60/352,627 filed Jan. 28, 2002.

REFERENCES CITED

| | | | |
|---|---|---|---|
| 183,124 | Oct. 1876 | Butterweck | |
| 1,339,949 | May 1920 | Egts | 124/27 |
| 1,488,995 | Apr. 1924 | McCollom | 124/66, 124/27 |
| 1,556,846 | Nov. 1922 | Kovacs | |
| 1,575,644 | Mar. 1926 | Schmidt | |
| 2,321,077 | Mar. 1940 | Gora El Al | |
| 2,600,883 | Dec. 1947 | King | |
| 2,630,108 | Jul. 1949 | White | 124/65 |
| 2,652,822 | May 1949 | Griffith | |
| 2,725,869 | Jun. 1952 | Barber | 124/35 X |
| 3,002,294 | Sep. 1960 | Jackson | |
| 3,850,157 | Nov. 1974 | Prokupek | 124/27, 124/37, 273/26 D |
| 4,159,705 | Jul. 1979 | Jacoby | 124/63, 124/70, 46/44 |
| 4,335,701 | Jun. 1982 | Bozich | 124/26, 124/81, 124/41 R, 124/83 |
| 4,644,930 | Feb. 1987 | Mainhardt | 124/58, 124/84, 42/16, 42/77 |
| 5,058,561 | Oct. 1991 | Starr | 124/65, 124/64 |
| 5,415,151 | May 1995 | Fusi/Gale | 124/56, 124/1 |
| 5,622,159 | Apr. 1997 | Liu/Melville,Jr. | 124/66, 124/65, 124/64, 222/79 |
| 6,048,280 | Apr. 2000 | Palmer/Palmer | 473/416, 473/570, 273/DIG. 24, 124/1, 124/16 |
| 6,142,135 | Nov. 2000 | Thompson | 124/70, 124/76 |

BACKGROUND OF THE INVENTION

The present invention relates to toy guns in general and more particularly to those that utilize a spring-driven plunger and compressed air to project paper, confetti, fiber, or fluid.

For decades toy guns with different functions have been popular with both children and adults. Air guns powered by a spring and compressed air are among the most common types of toy guns. Among the projectiles available are balls, darts, missiles, disks, arrows, and water.

Many prior inventions involve toy guns driven by a spring and possibly compressed air as well. Most projectiles in these cases consist of relatively rigid materials such as metal, glass, plastic, or foam, and all tend to remain an integrated unit after being launched and during flight. When fluid is projected, it is in the form of relatively continuous flows.

Each of the following toy guns is in the form of a "gun." U.S. Pat. No. 183,124 (Butterweck) discloses a toy gun which ejects a spherical projectile from the barrel utilizing a contracted spring as the sole source of power. Its trigger is designed to catch on a piston in the barrel. U.S. Pat. No. 1,339,949 (Egts) discloses a double-barreled toy gun which launches a small spherical projectile from the first barrel, using an extended spring in the second barrel as the power source. U.S. Pat. No. 1,488,995 (McCollom) also discloses a double-barreled toy gun, which compresses air by the movement of a spring and a plunger in the two barrels, discharging a missile-shaped projectile. Its trigger catches on the middle portion of a spring to hold the gun in a state ready for firing. U.S. Pat. No. 1,575,644 (Schmidt) discloses a toy gun with a trigger as its source of power, utilizing both a spring and compressed air as agents. When the trigger is pressed, the power is transferred through a series of mechanisms to contract a spring within the barrel. When the trigger is released, the potential energy of the spring ejects the projectile. U.S. Pat. No. 2,321,077 (Gora Et Al) discloses a toy gun within whose barrel is a spring that is compressed by the tail of a dart. The contracted spring is held by a trigger, the release of which ejects the projectile. U.S. Pat. No. 2,630,108 (White) discloses a toy gun that projects ping-pong balls utilizing the potential energy of a contracted spring and compressed air as an agent. U.S. Pat. No. 2,652,822 (Griffith) discloses a toy gun, with a rod and a spring, which projects a ping-pong ball like projectile by utilizing the energy produced by dragging the rod and compressing the spring. U.S. Pat. No. 2,725,869 (Barber) discloses a long gun, which uses a plunger to generate compressed air and to eject a ball-shaped projectile.

The following projectors are in the form of a long cylinder and use a spring or compressed air to generate power for the projection. U.S. Pat. No. 1,556,846 (Kovacs) discloses a launching tube containing a rod that is drawn to contract a spring. U.S. Pat. No. 2,600,883 (King) discloses an apparatus in which a rod is drawn to contract a spring, which once released, is able to fire balls. U.S. Pat. No. 4,335,701 (Bozich) discloses a projector that ejects a baseball, utilizing a spring as the power source and a long rod as an agent for transmitting the power. U.S. Pat. No. 5,058,561 (Starr) discloses a launching tube, which manually ejects cylindrical projectiles such as empty beverage cans using compressed air as an agent.

The following two patents emphasize the visual effects of projectiles in dark surroundings. U.S. Pat. No. 5,415,151 (Fusi) involves a bullet-shaped phosphor-containing projectile that creates clear visual effects in darkness. The invention discloses a round capsule containing a phosphor-containing fluid. However, the purpose of the art is to keep the projectile visible in flight and to leave a luminous mark on targets the projectile strikes. As such, the projectile remains integrated in flight until it reaches the target. U.S. Pat. No. 6,048,280 (Palmer/Palmer) discloses a toy gun that projects a dart using as an agent compressed air generated by a drawn rod and a released spring. The gun contains a flash lamp to create the fluorescent effects of the propelled projectile.

The above-mentioned launching devices have at least one of the following features, which differentiate them from the present invention: 1) the appearance of a "gun," 2) horizontal "shooting" as the primary function, 3) rigid projectiles such as balls, darts, beverage cans, and special bullets that stay integrated during flight, 4) a target for shooting. Projectiles in all above-mentioned devices remain integrated after being ejected. Having one or more of these characteristics renders past inventions unsuitable for usage at large social gatherings.

The present invention is entirely dissimilar from above-mentioned apparatuses. The device is to be used for leisure. The primary function of the present invention is to project and disseminate soft and non-integrated materials contained in a cartridge, generally vertically and without aiming at a target. Additionally, the outside surface of the present invention can be covered with fluorescent materials for decorative purposes. A flag may also be attached to the upper section of the launching tube. These and other features could be appropriate at sporting or music events, wedding ceremonies, holiday celebrations, parties, or other large social gatherings.

SUMMARY OF THE INVENTION

In consideration of disadvantages of known types of toy gun devices, whose primary purposes are to horizontally project various hard projectiles that remain integrated after being ejected, the present invention is a new type of projecting device, which may be held in the hand and may project, usually vertically, soft projectiles such as paper disks, confetti, or fluid.

The general purpose of the present invention is to provide a new, simply constructed device that "projects" for visual pleasure but does not "shoot." None of these advantages and new features have been shown or suggested in the prior art projecting devices.

For this purpose, the present invention consists of two sections of a launching tube, a plunger, a spring, a trigger, and a cartridge, which will be described with all details later.

A primary object of the present invention is to provide a projecting device capable of launching, usually vertically, soft projectiles such as paper disks, confetti, or fluid for visual pleasure.

Another object is to provide a cartridge with a variety of possible contents, including but not limited to paper disks, confetti, and fluid, which may be treated with fluorescent materials in order to create pleasant visual effects in the dark. Letters or words could also be printed on paper disks. The disks could also display messages such as fortunes. Alternatively, they could show numbers and be used for drawing lots. To create a cheerful atmosphere, the substances being projected may also be scented.

A further object is to provide a projecting device not in the form of a "gun" but that of a long stick, the cross section of which may be circular, triangular, rectangular, or any other shape. The advantage of a stick-like structure is that additional adaptations are possible. For instance, the device may be used as a flagpole.

Another object is to provide a simply-constructed and inexpensive projecting device. The simplicity of the structure makes this device affordable and easy to use.

Still another object is to provide a light-weight, simply-operated, and easy-to-carry projecting device able to be held in one hand.

A further object is to provide a projecting device for repeated use.

An additional object is to provide a projecting device at a much larger scale, with the same structure as formerly described, in order to meet various demands on different occasions.

Another object is to provide a horizontal complex of projecting devices, with combined or separate triggers in order to eject projectiles from more than one device simultaneously.

The device is further described using accompanying illustrated drawings.

DESCRIPTION OF THE PREFERRED EMBODIMENT

Figure 1:
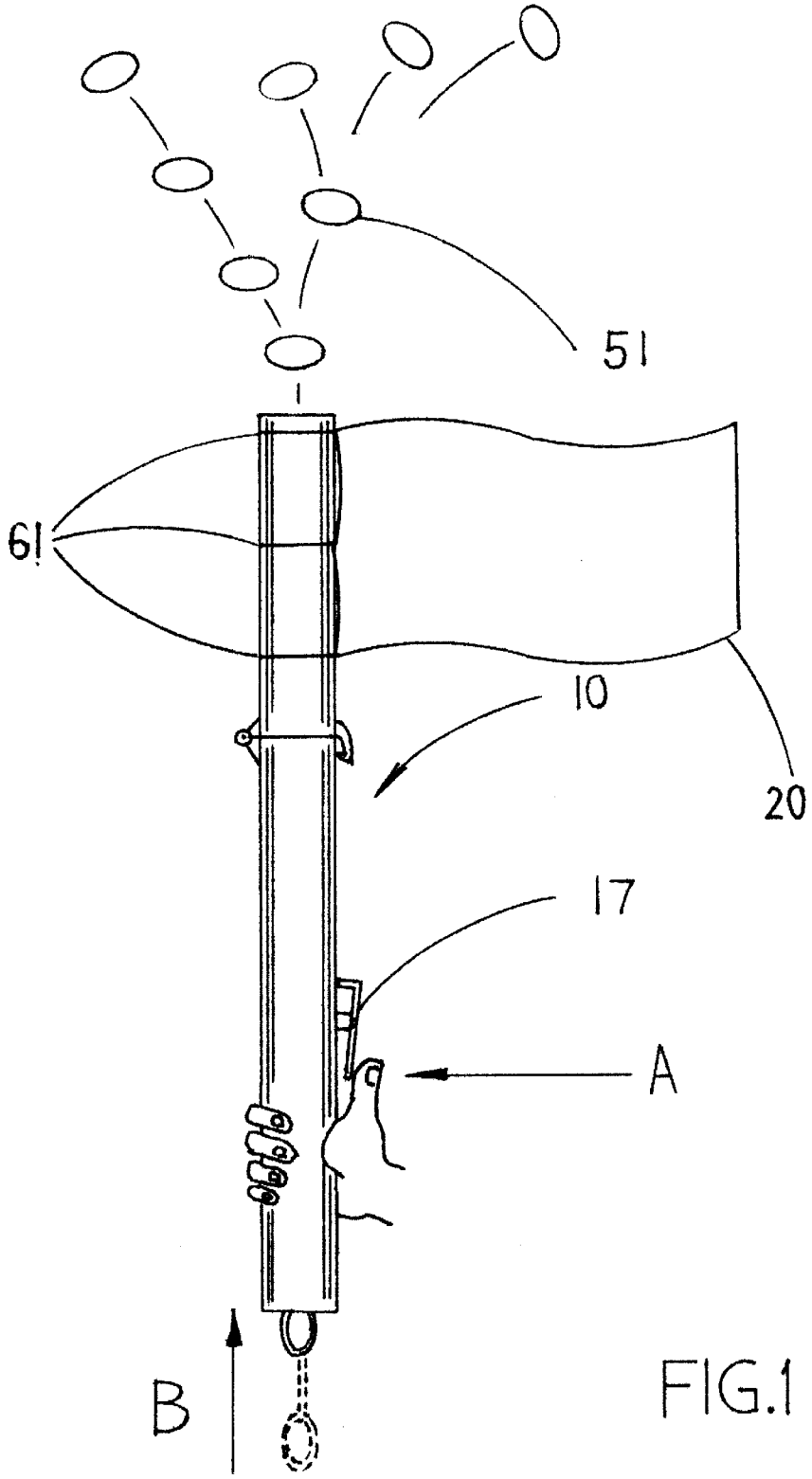
FIG. 1 is a side view of the present invention.
Figure 2:
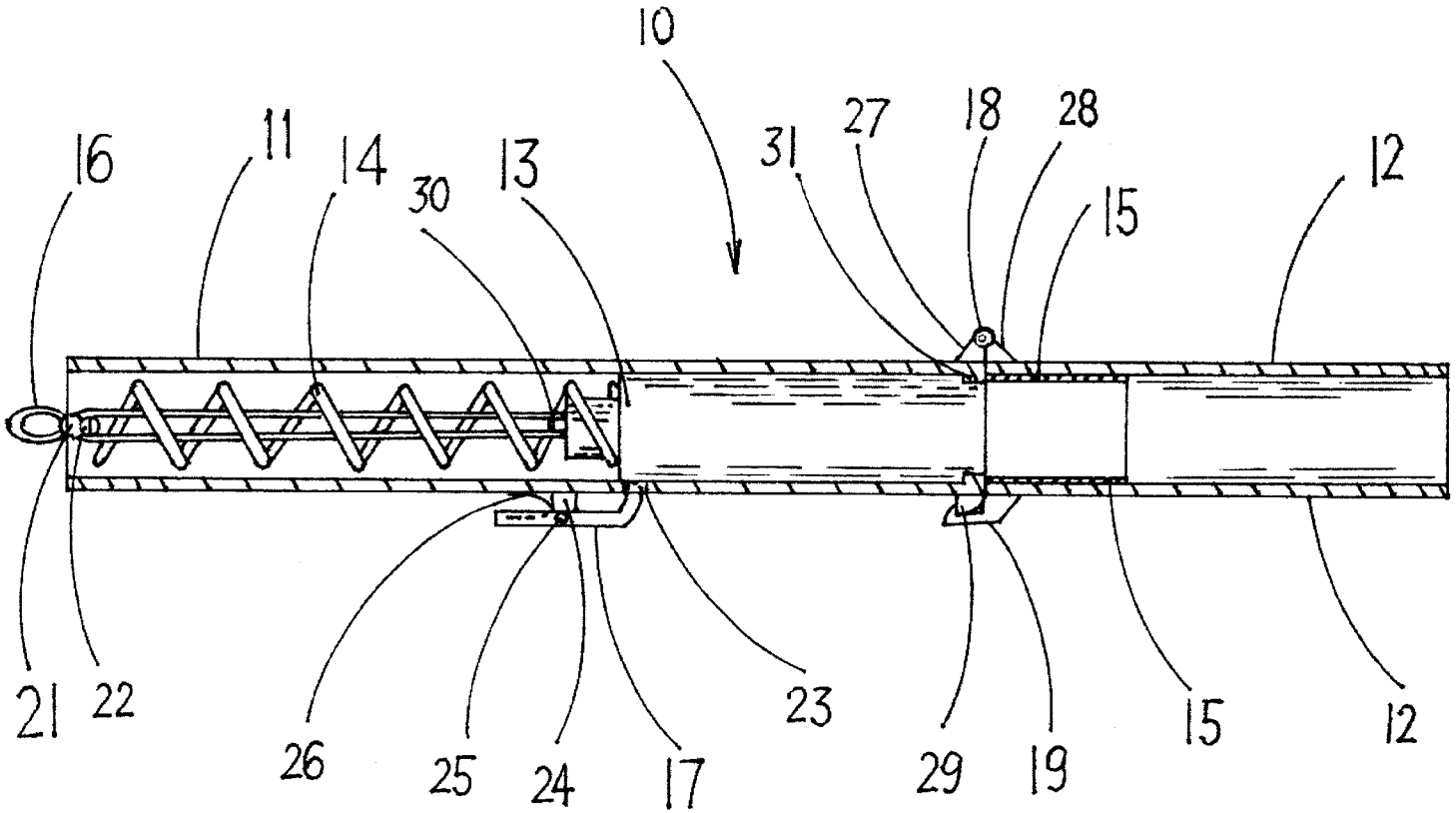
FIG. 2 is a sectional view of the present invention.

FIGS. 1–4 show the present invention 10 completely. As shown in FIG. 2, the present projecting device 10 consists of a lower section 11 of the launching tube, an upper section 12 of the launching tube, a plunger 13, a spring 14, a cartridge 15, a pulling string 16, a trigger 17, a v-shaped pivot component 18, and a hook 19.

Figure 3:
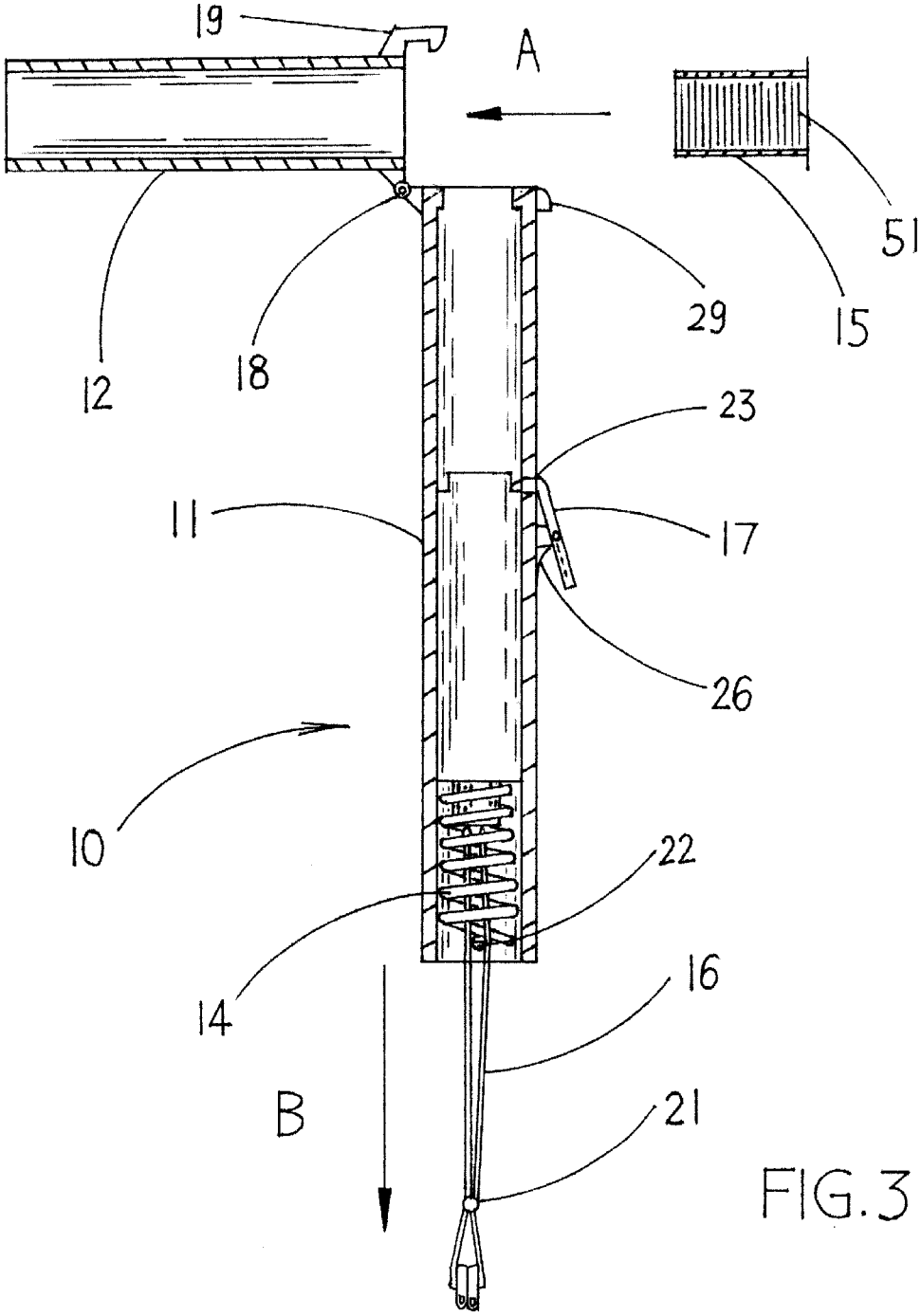
FIG. 3 is a sectional view of the present invention where the upper section of the launching tube is folded to the side and the cartridge is being loaded.
Figure 4:
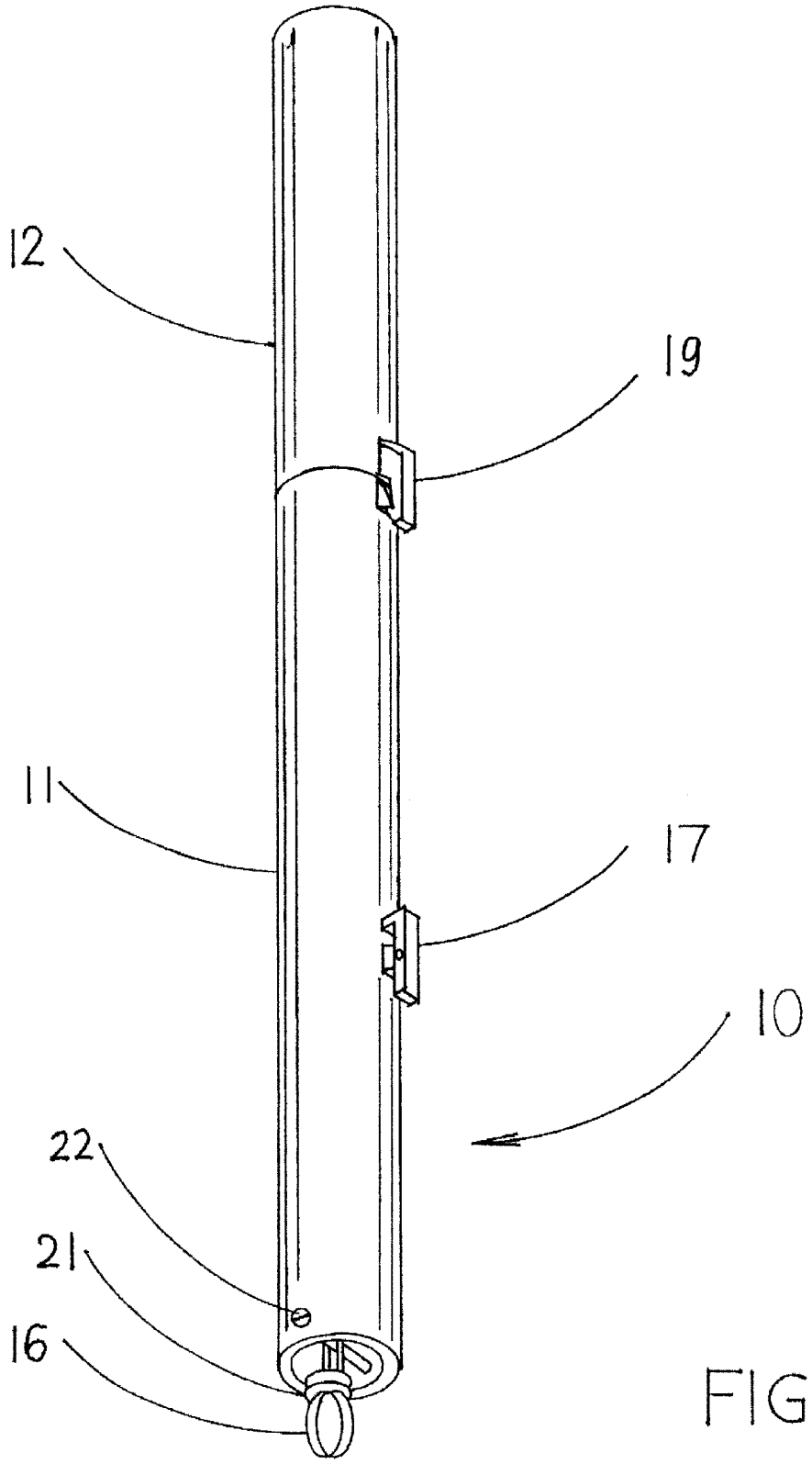
FIG. 4 is a perspective view of the present invention after the projection.

As shown in FIGS. 1–4, the lower section 11 and the upper section 12 of the launching tube have the same diameter. The two sections are connected with a v-shaped pivot component and a hook. As shown in FIGS. 1, 2, and 4, the lower section 11 and the upper section 12 are in rectilinear state immediately before, during and after the launching of the projectile. As shown in FIG. 3, before the user inserts the cartridge 15 and pulls back on the string 16, the upper section 12 folds to the side, forming with the lower section 11 a "7" shape. Then, the user loads a cartridge 15 into the upper section 12.

As shown in FIGS. 2–3, within the lower section 11 are the plunger 13, the spring 15, and the string 16. A long screw 22 is installed near the end of the lower section 11. The trigger 17 is installed on the outside surface of the lower section 11.

As shown in FIG. 2, the top of the lower section 11 has a inner collar flange 31 designed to keep the plunger 13 within the lower section 11 as the plunger 13 moves upward, driven by the released spring 14. Thus, the diameter of the plunger 13 should be slightly smaller than the lower section of the launching tube 11 so that the plunger 13 can smoothly slide and reciprocate within the tube.

Figure 6:
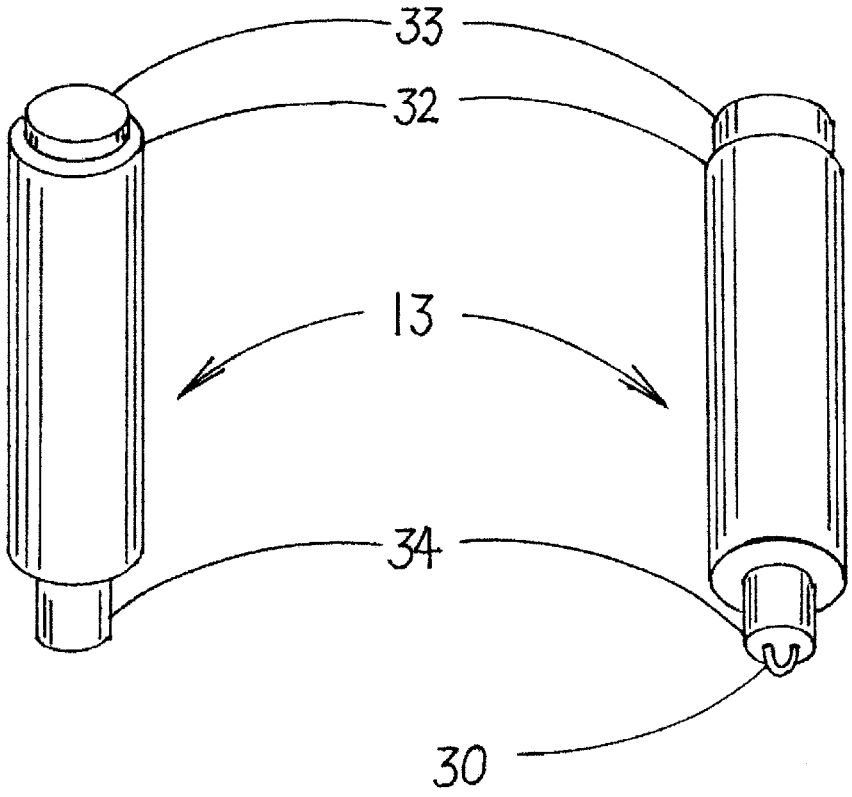
FIG. 6 is a perspective view of the plunger shown in FIGS. 2–3.

As shown in FIG. 6, the plunger 13 has a main body 32 which may move smoothly within the lower section 11. The plunger 13 also has a top portion 33, the diameter of which is smaller than that of the main body 32. When the plunger 13 is released, the top portion 33 directly hits the bottom of the cartridge 15. The lower portion 34 of the plunger 13 also has a diameter much smaller than that of the main body 32 so that the lower portion 34 can be inserted into the spring 14. The string 16 goes through a loop 30 found on the bottom of the lower portion 34.

As shown in FIGS. 2, 3, and 6, the upper end of the spring 14 surrounds the lower portion 34 of the plunger 13. A screw 22 keeps the rear end of the spring 14 from being pressured out of the lower section 11 of the tube when the string 16 is pulled.

As shown in FIGS. 1–4, the string 16, connected to the plunger 13 by the loop 30, is used to pull the plunger 13 downwards. FIG. 3 shows the user pulling on the string 16. Near its lower end the string 16 is knotted 21 in order to prevent the lower end of the string 16 from receding into the tube. When the spring 14 releases and the string 16 is moving upwards, the screw 22 stops the string 16 at the knot 21, and the rear end of the string 16 remains outside of the launching tube.

Figure 5:
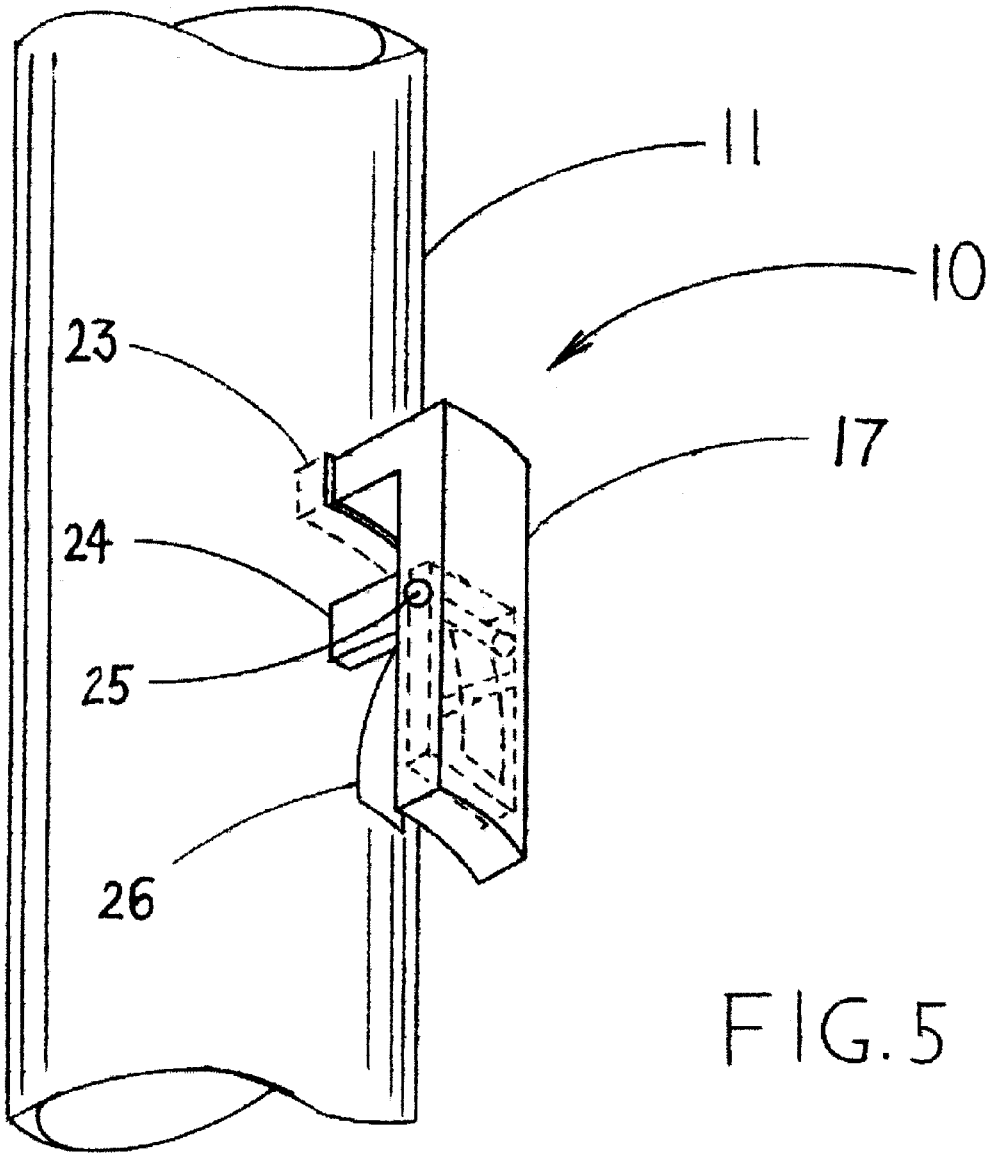
FIG. 5 is an enlarged perspective view of the trigger shown in FIG. 4.

As shown in FIGS. 1–4 and in particular detail in FIG. 5, a trigger 17 is installed on the outside surface of the lower section 11 of the launching tube, on the same side as the hook 19. The upper end of the trigger 17 digs into a gap 23 in the surface of the launching tube. When the string 16 is pulled backwards, the front of the trigger 17, affected by a leaf spring 26, enters into the launching tube and blocks the upward motion of the spring 14 by stopping the upper end of the plunger 13 and allowing the projecting device 10 to enter a ready-to-launch state. The trigger 17 is connected and fixed to a support base 24 by a long screw 25. The leaf spring 26 is installed between the trigger 17 and the support base 24 in order for the front of the trigger 17 to automatically be pushed into the launching tube and block the upper end of the plunger 13 while it is pulled downwards.

As shown in FIGS. 1–4, the v-shaped pivot component 18 includes a triangular flange 27 at the top of the lower section 11 and a triangular flange 28 on the bottom of the upper section 12. As shown in FIG. 2, the front of the hawk-beak hook 19 locks the flange 29 at the top of the lower section 11, which is in rectilinear state with the upper section 12. As shown in FIG. 3, the user must forcibly fold the upper section 12 to the side, disconnecting the hawk-beak hook 19 from the flange 29, in order to load the cartridge 15 into the open end of the upper section 12. At this time, the lower section 11 and the upper section 12 of the launching tube are connected by the pivot 18.

Figure 7:
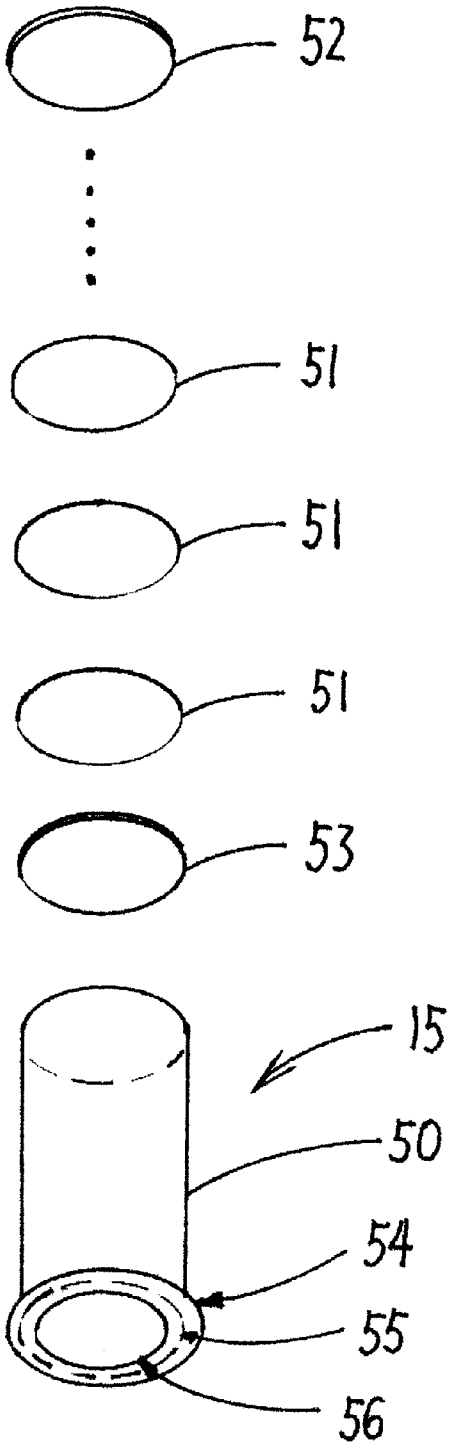
FIG. 7 is an exploded view of the cartridge and its contents after they are expelled from the launching tube.

As shown in FIGS. 2, 3, and 7, the user must insert the cartridge 15 into the open end of the upper section 12 of the launching tube before the projection. As shown in FIG. 7, the cartridge 15 consists of a container 50 holding paper disks 51, an adhesive piece of paper 52 for sealing the front end of the cartridge 15, and a piece of cardboard 53 for blocking the rear end of the cartridge 15. The container 50 has a rear end with an extended ridge outside 54 and inside 56. The dashed line 55 shows the conjunction at which the wall of the container 50 connects to the ring that gives it an outer 54 and inner ridge 56. Lucky phrases and numbers for drawing lots may be printed on the paper disks 51, or fluorescent materials may be added to create pleasing visual effects in the dark. The adhesive piece of paper 52 is sticky on the edges in order to keep all contents within the container 50. The solidity of the adhesive paper 52 should be such that the contents may leave the container 50 freely once compressed air hits the bottom of the cartridge 15. If the contents of the cartridge 15 are paper disks 51 or confetti, a piece of cardboard 53 is used on the bottom of the cartridge 15. If the content is a fluid, waterproof plastic adhesive tape should be used on the bottom of the cartridge 15 in order to keep the fluid within the container 50 without leaking. The solidity of the waterproof plastic should be such that allows the expulsion of the fluid when compressed air hits the bottom of the cartridge 15. As shown in FIG. 2, the lower section 11 and the upper section 12 of the launching tube, the plunger 13, and the trigger 17 may use PVC as the raw material for injection processing. The plunger 13 is a hollow cylinder. The leaf spring 26 is u-shaped, with resilience to become straight.

As shown in FIG. 3, the user folds the upper section 12 of the launching tube to the side, disconnecting the hawk-beak hook 19 from flange 29, allowing the upper section 11 and the lower section 12 of the launching tube to change from a rectilinear state to a "7" shape, connected by the v-shaped pivot 18. The user then inserts the cartridge 15 into the upper section 12 in direction A until the outside ridge 54 of the cartridge 15 is closely pressed to the bottom of the upper section 12 of the launching tube. Then, as in FIG. 3, the user pulls the string 16 in direction B to contract the spring 14 into a ready-to-launch state, where the front end of the trigger 17, affected by the resilience of the leaf spring 26, digs into a gap 23 in the launching tube, blocking the plunger 13. The user then restores the upper section 12 to a rectilinear state with the lower section 11, allowing the entire projecting device 10 to enter a state fully ready for projection. As shown in FIG. 1, when the user presses the trigger 17 in direction A, the plunger 12, pushed by the spring 14, moves upwards inside the launching tube in direction B. Compressed air in the launching tube propels the paper disks 51 or other contents into flight from the launching tube.

Although the above description of the present invention includes illustrations and detailed explanations, it does not limit the present invention within the illustrations and descriptions. Some changes and modifications may take place within the scope of the present invention without modifying its basic principles.

I claim:

1. A multi-purpose projecting device for propelling and disseminating, generally vertically, pap disks, confetti, or fluid contained in a cartridge, comprising:

a launching tube having circular cross section, an upper section and a lower section connected by a v-shaped pivot component and a hawk-beak hook for easily folding the upper section to the side;

a plunger disposed within the launching tube for free slide and reciprocation therein to propel and disseminate projectiles from the top end of the upper section of the launching tube; the plunger has a semi-circular loop on its bottom in order to let a string pass through;

a plunger driving means within the launching tube having a spring, a string and a long screw for compressing and releasing the spring to eject projectiles;

a trigger means installed on the outside surface of the lower section of the launching tube, on the same side as the hawk beak hook, having a body, a base, a leaf spring and a screw for blocking and releasing the spring's movement within the launching tube as the upper end of the trigger digs into and pulls out of the launching tube through a gap on the wall of the launching tube;

a plurality of cartridges, having about same diameter as the inner cross section of the upper section of the launching tube and being insertable into the lower end of the upper section of the launching tube, consisting of a container, a sealing means a plurality of contents, including paper disks, confetti, or fluid;

a flag, having 2–3 elastic string rings on one side for easily fixing said flag to the upper section of the launching tube.

2. The invention as defined in claim 1 wherein said v-shaped pivot component and a hawk-beak hook are installed on opposite sides of the outside surface of the launching tube, and on the conjunction of the upper and lower sections of the launching tube for easily folding the upper section to the side, changing the launching tube from rectilinear state to "7" shape and vice versa.

3. The invention as defined in claim 1 wherein said v-shaped pivot component includes a triangular flange on the outside surface at the top of the lower section and a triangular flange on the outside surface at the bottom of the upper section of launching tube, both flanges connected with a screw at the tops for easily folding the upper section of the tube to the side.

4. The invention as defined in claim 1 wherein said hawk beak hook includes a hawk beak hook on the bottom of the upper section of the launching tube and a approximate triangular flange at the top of the lower section of the launching tube, the head of the hawk beak hook may easily lock or release the triangular flange when the launching tube is in the rectilinear state or "7" shape, respectively.

5. The invention as defined in claim 1 wherein the top end of said lower section of the launching tube has an inner collar flange for limiting movement of the plunger within the lower section of the launching tube and allowing the top of the plunger to directly hit the bottom of the cartridge for ejection.

6. The invention as defined in claim 1 wherein said plunger, by impetus of the spring, may move and compress a bolus of air within the launching tube and eject the contents of the cartridge through the upper section of the launching tube.

7. The invention as defined in claim 1 wherein said plunger includes a main body, which may move smoothly within the lower section of the launching tube, a top portion, a lower portion and a semi-circular loop on the bottom of the lower portion of the plunger for allowing the string to pass through.

8. The invention as defined in claim 1 wherein the diameter of the top portion of said plunger is smaller than that of the main body for allowing the top portion to directly hit the bottom of the cartridge, and the diameter of the lower portion is also smaller than that of the main body for allowing the lower portion to insert into the spring.

9. The invention as defined in claim 1 wherein the top of said spring surrounds the lower portion of the plunger and the rear of said spring is held by the long screw disposed near the lower end of the launching tube.

10. The invention as defined in claim 1 wherein said string, passing through the semi-circular loop on the bottom of the lower portion of the plunger and the long screw near the bottom end of the launching tube, has a knot for keeping the lower end of the string outside of the launching tube, and then, the string has a second knot in an appropriate place for allowing the user's fingers to pass through to pull the string forcedly.

11. The invention as defined in claim 1 wherein said trigger includes a body, a base, a leaf spring and a screw, disposed on the surface of the wall of the lower section of the launching tube, allowing the upper end of the trigger to dig into the launching tube through the gap on the wall of the launching tube and to block the movement of the plunger as it is driven backwards, allowing the upper end of the trigger to pull out as the lower end of the trigger is pushed to the wall of the launching tube to release the plunger.

12. The invention as defined in claim 1 wherein said cartridge includes a container, a sealing meams, and a verity of contents including paper disks, confetti, or fluid.

13. The invention as defined in claim 1 wherein said container is a hollow cylinder having a extended outside ridge at its bottom for keeping the container within the launching tube as contents of the cartridge are ejected by the force of the compressed air, and an extended inside ridge also at the cartridge's bottom for holding a piece of cardboard or a piece of adhesive plastic film, when paper disks and confetti or fluid are loaded as contents, respectively.

14. The invention as defined in claim 1 wherein said contents of the cartridge include paper disks, confetti, fluid, or other soft materials such as fibers, string, fabric, etc.

15. The invention as defined in claim 1 wherein the sealing means includes a piece of paper for sealing the top of the container and a piece of cardboard for sealing the bottom of the container when the contents are non-fluid, or 2 pieces of adhesive waterproof plastic films when the contents are fluid.

16. The invention as defined in claim 1 wherein said non-fluid contents may be covered with fluorescent materials for creating special visual effects in the dark.

17. The invention as defined in claim 1 wherein said paper disks may be printed with lucky phrases or numbers for drawing lots when the cartridge has paper disks as its contents.

18. The invention as defined in claim 1 wherein said fluid may have perfume added to it when fluid is used as contents of the cartridge.

19. The invention as defined in claim 1 wherein said launching tube may have fluorescent materials to cover its surface for creating special visual effects in the dark.

20. The invention as defined in claim 1 wherein said flag has 2–3 elastic string rings to easily fix the flag to the upper section of the launching tube.

* * * * *